US007976342B2

(12) United States Patent
Farole et al.

(10) Patent No.: US 7,976,342 B2
(45) Date of Patent: Jul. 12, 2011

(54) HIGH DENSITY RECTANGULAR INTERCONNECT

(75) Inventors: Dominic Anthony Farole, Hummelstown, PA (US); Keith Edwin Miller, Manheim, PA (US); Ricardo Lee Koller, Lititz, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 169 days.

(21) Appl. No.: 12/132,930

(22) Filed: Jun. 4, 2008

(65) Prior Publication Data

US 2009/0305570 A1 Dec. 10, 2009

(51) Int. Cl.
*H01R 13/648* (2006.01)

(52) U.S. Cl. ..... 439/607.57

(58) Field of Classification Search ..... 439/607.02, 439/607.04, 607.27, 607.41–607.52, 607.55–607.58
See application file for complete search history.

(56) References Cited

U.S. PATENT DOCUMENTS

| | | | | |
|---|---|---|---|---|
| 3,848,950 | A | 11/1974 | McCormick et al. | |
| 4,629,272 | A | 12/1986 | Mattingly et al. | |
| 4,744,770 | A | 5/1988 | Drogo | |
| 5,228,871 | A * | 7/1993 | Goodman | 439/607.56 |
| 5,501,612 | A | 3/1996 | Green | |
| 5,637,010 | A | 6/1997 | Jost et al. | |
| 5,743,765 | A * | 4/1998 | Andrews et al. | 439/607.1 |
| 5,785,557 | A | 7/1998 | Davis | |
| 6,139,365 | A | 10/2000 | Lok | |
| 6,315,620 | B1 * | 11/2001 | Moir et al. | 439/862 |
| 6,749,463 | B1 | 6/2004 | Fan | |
| 6,846,996 | B2 | 1/2005 | Kent et al. | |
| 6,875,037 | B2 | 4/2005 | Collin et al. | |
| 6,890,220 | B2 | 5/2005 | Wang | |
| 7,056,152 | B2 | 6/2006 | Huang et al. | |
| 7,075,023 | B2 | 7/2006 | Kent et al. | |
| 7,160,151 | B1 | 1/2007 | Rigby et al. | |
| 7,160,153 | B1 | 1/2007 | Huang | |
| 7,256,362 | B2 | 8/2007 | Kent et al. | |
| 7,258,565 | B2 | 8/2007 | Huang et al. | |
| 7,273,992 | B2 | 9/2007 | Kent et al. | |
| 7,354,282 | B2 | 4/2008 | Margulis et al. | |
| 2002/0028604 | A1 * | 3/2002 | Lo et al. | 439/607 |
| 2007/0149011 | A1 | 6/2007 | Kent et al. | |

FOREIGN PATENT DOCUMENTS

| | | | |
|---|---|---|---|
| WO | 2004057630 | A2 | 7/2004 |
| WO | 2004075349 | A2 | 9/2004 |

OTHER PUBLICATIONS

International Search Report for International Application No. PCT/US2009/002970, mailed Oct. 26, 2009.

* cited by examiner

*Primary Examiner* — Ross N Gushi

(57) ABSTRACT

A high density rectangular electrical interconnect is disclosed that includes a plug having a plurality of plug contacts mated to a receptacle having a plurality of spring contacts preloaded with an opening force to reduce mating force. The plurality of plug contacts may be a plurality of pin contacts, printed circuit board traces, or flexible film contacts. The plug and receptacle may include shields and/or shielding material that form a continuous shield around the mated plug and spring contacts.

16 Claims, 18 Drawing Sheets

HIGH DENSITY RECTANGULAR INTERCONNECT

FIELD OF THE INVENTION

The present invention relates generally to electrical connectors, and more particularly, to an electrical connector having a high density of contacts and a low mating insertion force.

BACKGROUND OF THE INVENTION

High density electrical connectors having a large number of contacts are used in a wide variety of applications. High density connectors are desirable because they reduce connector sizes, thereby requiring less overall space and eliminating excess bulk. This is highly advantageous in many applications, such as medical, aircraft and aerospace applications, where cost, space and weight savings are at a premium.

As the density of electrical contacts used in such applications increases, problems arise upon mating of the connectors due to the high insertion force required to mate the high number of contacts. The high insertion forces required to mate the high number of contacts, especially in environments where the connectors are not easily accessed, or in a blind mating condition, or where the connectors must be cycled repeatedly, or where cost must keep the design complexity of the connector to a minimum, has presented a problem for current connector design. Therefore, there is a need for an improved high density connector, which requires a reduced insertion mating force.

SUMMARY OF THE INVENTION

In an exemplary embodiment of the invention, an electrical connector is disclosed that includes a plug and a receptacle. The plug includes a plug shell and a shielded plug sub-assembly housing disposed therewithin, and at least one plug contact sub-assembly disposed within the shielded plug sub-assembly housing. The at least one plug contact sub-assembly comprises a plurality of plug contacts. The receptacle includes a receptacle shell, a receptacle shield disposed within the receptacle shell, and a receptacle sub-assembly housing. The receptacle sub-assembly housing includes a front portion, a rear portion disposed within the receptacle shield, and at least one spring contact sub-assembly slot. A receptacle contact sub-assembly is received within the at least one spring contact sub-assembly slot, and the at least one spring contact sub-assembly includes a plurality of spring contacts. The plug and receptacle are configured to mate, thereby mating the plurality of plug contacts and plurality of spring contacts and to conductively connect the plug shield and the receptacle shield. The plurality of spring contacts may be preloaded with an opening force.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
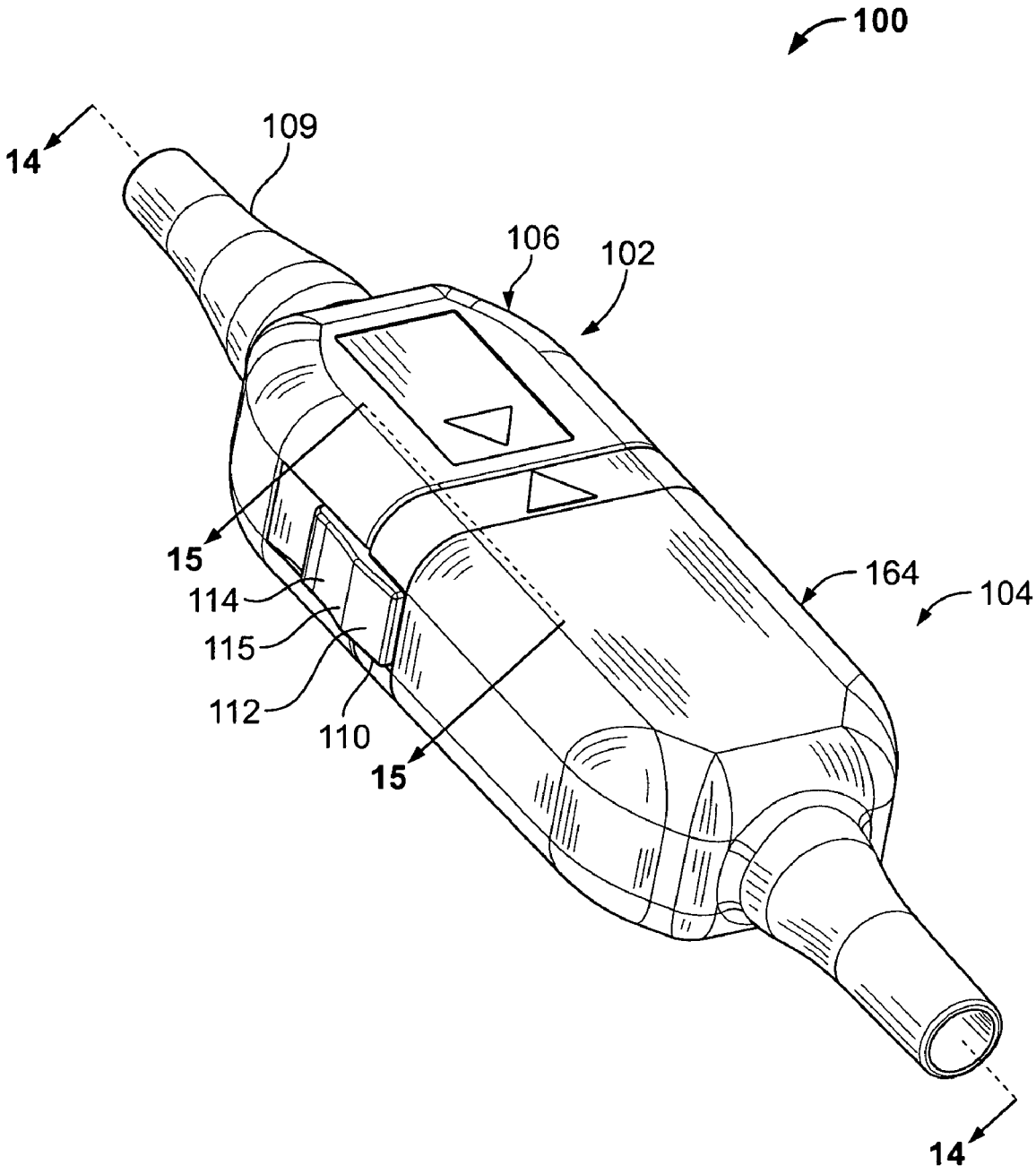
FIG. 1 is a perspective view of an exemplary mated electrical connector according to the invention.
Figure 2:
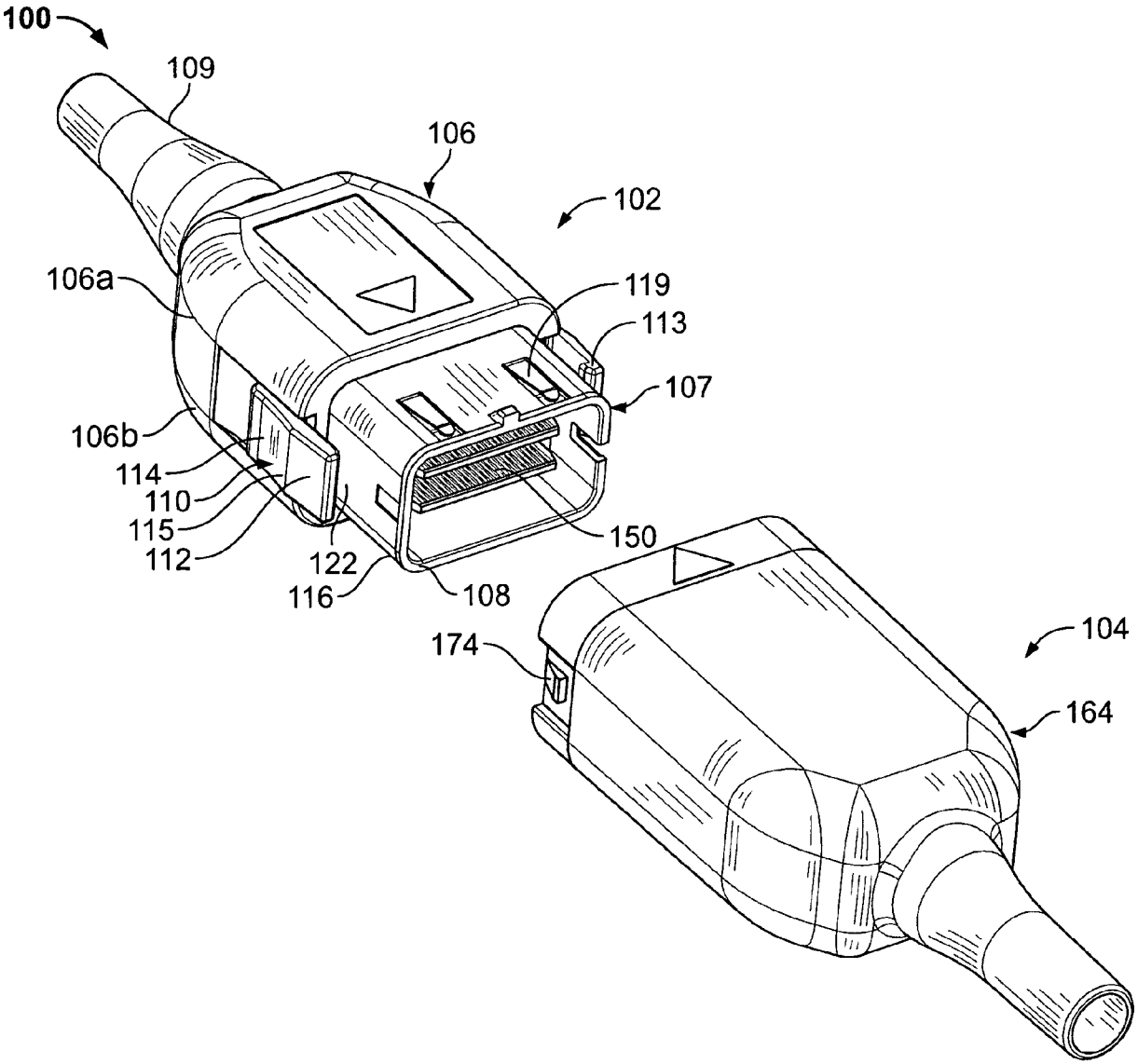
FIG. 2 is a perspective view of the unmated electrical connector of FIG. 1.

An exemplary embodiment of a high density/low insertion force electrical connector 100 according to the present invention is shown in FIGS. 1 and 2. The electrical connector 100 is shown mated in FIG. 1 and unmated in FIG. 2. The electrical connector 100 includes a plug 102 and a receptacle 104. The plug 102 and receptacle 104 are configured to be releasably mated, as will be described in further detail below.

Figure 3:
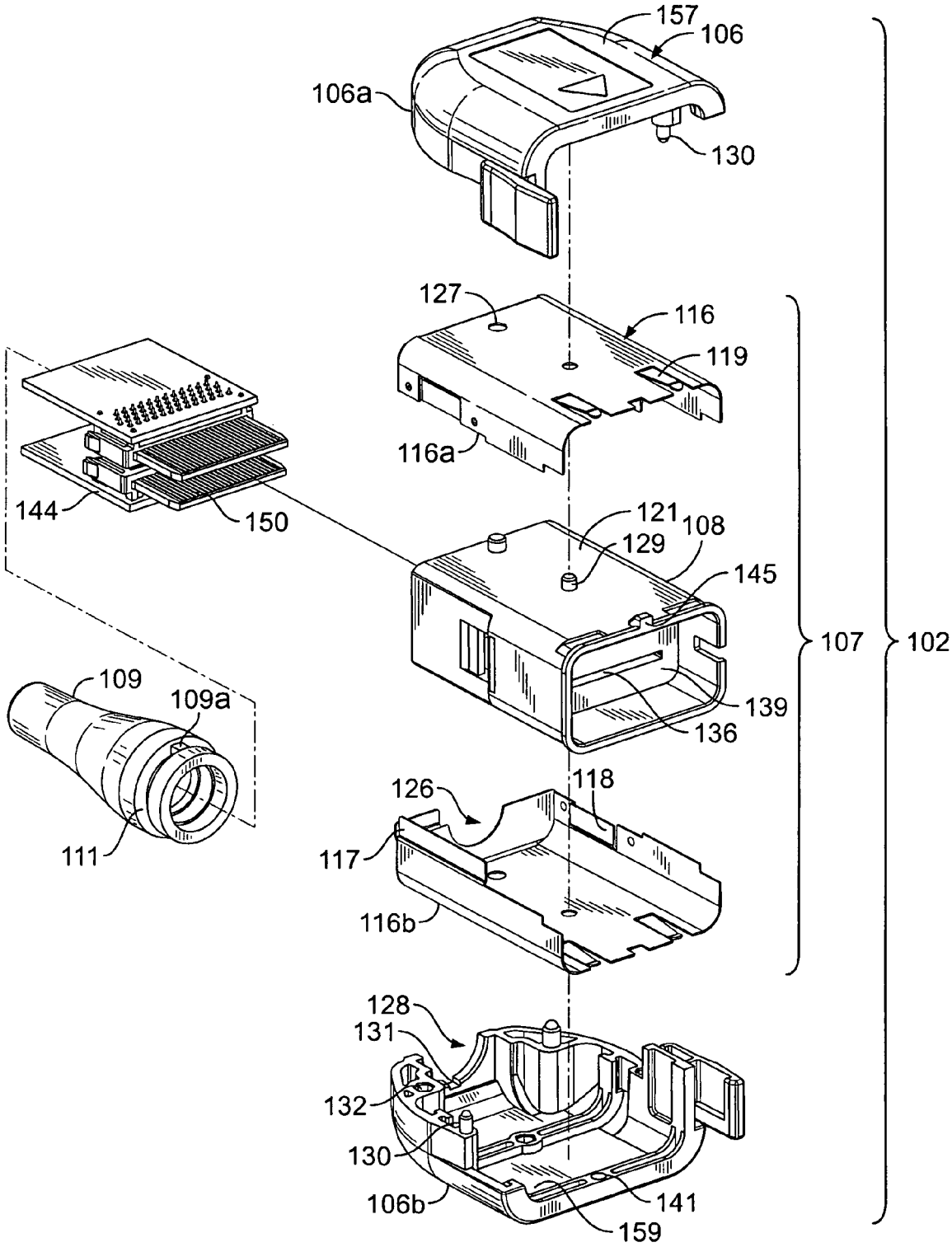
FIG. 3 is an exploded view of an exemplary embodiment of a plug according to the invention.

As can be seen in FIGS. 1 and 2, the plug 102 includes a plug shell 106, a plug shielded sub-assembly housing 107, a plug contact sub-assembly 144 including a plurality of contacts 150, and a plug flexible cable connector 109. As can be seen in FIGS. 2 and 3, the plug shielded sub-assembly housing 107 includes a plug shielded sub-assembly housing insertion portion 122 not disposed within the plug shell 106. The plug shielded sub-assembly housing 107 includes a plug sub-assembly housing 108 disposed within a plug shield 116. In another embodiment, the plug shielded sub-assembly housing 107 may include an electrically shielding material (not shown) disposed on an exterior surface 121 of the plug sub-assembly housing 108. In yet another embodiment, the plug shielded sub-assembly housing 107 may include an electrically shielding material (not shown) disposed on an inner surface 147 (FIG. 4) of the plug sub-assembly housing 108. The electrically shielding material may be disposed on the exterior surface 121 and/or inner surface 147 by plating, coating or other similar surfacing method. In another embodiment, the plug shield 116 may be omitted, and no electrical shielding material may be included in the plug 102.

As can be seen in FIGS. 2 and 3, the plug shell 106 is at least partially disposed around the plug shielded sub-assembly housing 107. The plug shell 106 includes an outer surface 157 and an inner surface 159. The outer surface 157 includes latches 110. The latches 110 include front sections 112 and rear sections 114. The front sections include latch retaining surfaces 113. The latches 110 are configured to attach to the plug shell 106 to permit the front sections 112 and rear sections 114 to pivot about pivot sections 115 so as to move the front sections 112 away from the plug shielded sub-assembly housing 107 when force is applied to the rear sections 114, as would be appreciated by one of ordinary skill in the art. Thus, the plug 102 may be un-mated from the receptacle 104 by applying a force to rear sections 114 to depress the rear sections 114 towards the plug shell 106, thereby pivoting the front sections 112 away from the plug shell 106 and unlatching the plug 102 from the receptacle 104. The plug 102 may then be unmated from the receptacle 104. In another embodiment, the inner surface 159 of the plug shell 159 may include an electrical shielding material disposed thereon.

The plug shell 106 includes a first plug shell portion 106*a* and a second plug shell portion 106*b*. The plug shell portions 106*a*, 106*b* are hermaphroditic and include shell assembly pins 130 and shell assembly recesses 132 configured to securely assemble the plug shell portions 106*a*, 106*b* together to form the plug shell 106. In another embodiment, the plug shell portions 106*a*, 106*b* may have snaps, pins or any fastener configuration to assemble the plug shell portions 106*a*, 106*b* to form the plug shell 106. In yet another embodiment, the plug shell 106 is a unitary body and the plug shielded sub-assembly housing 107 is accordingly modified to be received and retained therewithin.

The plug shell portions 106*a*, 106*b* further includes a plug shell rear opening 128, half of which is formed by each plug shell portion 106*a*, 106*b*, for receiving and securing plug flexible cable connector 109. In this exemplary embodiment, the plug flexible cable connector 109 includes a generally circular groove 111 that is secured in the plug shell rear opening 128 when the first shell portion 106*a* and the second shell portion 106*b* are assembled to form the plug shell 106. The plug flexible cable connector 109 may be of any length, and may be terminated and/or connected to another electrical device or connection (not shown) as would be appreciated by one of ordinary skill in the art. In another embodiment, the flexible cable connector 109 and the plug housing shell 106 may be otherwise configured with clamps, pins, slots or other fasteners to secure the flexible cable 109 to the plug housing shell 106. Additionally, while the plug shell rear opening 128 and groove 111 are shown having a generally circular geometry, it should be appreciated by one of ordinary skill in the art that the plug shell rear opening 128 and groove 111 may have any shape, including, but not limited to square, rectangular, and oval. In addition, flexible cable connector 109 may include a keying feature 109*a* corresponding with a plug shell keying feature 131 to prevent the flexible cable connector 109 from rotating or twisting within the plug shell rear opening 128. In operation, a cable or wire having a plurality of conductors (not shown) would be provided through or within the flexible cable connector 109 and terminated to pads, traces, the plurality of plug contacts 150 and/or other termination features of the plug contact sub-assembly 144 as would be appreciated by one of ordinary skill in the art.

The plug shell portions 106*a*, 106*b* further include shell recesses 141 for receiving sub-assembly housing pins 129 of the plug sub-assembly housing 108 to securely position the shielded plug sub-assembly housing 107 within the plug shell 106, when assembled.

The plug shield 116 includes a first plug shield portion 116*a* and a second plug shield portion 116*b*. The plug shield portions 116*a*, 116*b* are hermaphroditic and include tabs 117 and recesses 118 configured to securely assemble the plug shield portions 116*a*, 116*b* together to form the plug shield 116. In another embodiment, the plug shield portions 116*a*, 116*b* may have snaps, pins or any fastener configuration to assemble the plug shield portions 116*a*, 116*b* to form the plug shield 116. The plug shield portions 116*a*, 116*b* also include conductive mating tabs 119 that assist in forming a conductive connection between the plug shield 116 and the receptacle shield 175 (FIG. 10) when the plug 102 and receptacle 104 are mated. The plug shield portions 116*a*, 116*b* further include a plug shield rear opening 126 configured to provide access to conductors (not shown) provided through the plug flexible cable connector 109 to termination at the plug contact sub-assembly 144.

The plug shield portions 116*a*, 116*b* also include plug shield pin holes 127 configured to receive sub-assembly housing pins 129 to securely position the plug shield 116 in position about the plug sub-assembly housing 108. In another embodiment, the plug shield pin holes 127 and sub-assembly housing pins 129 may be omitted. In yet another embodiment, other tabs, pins, recesses or similar engaging structures may be used to securely position the plug shield 116 around the plug sub-assembly housing 108. In still another embodiment, the plug shield 116 is a unitary body and the plug shell 106 and plug sub-assembly housing 108 are accordingly modified for assembly as would be appreciated by one of ordinary skill in the art.

Figure 4:
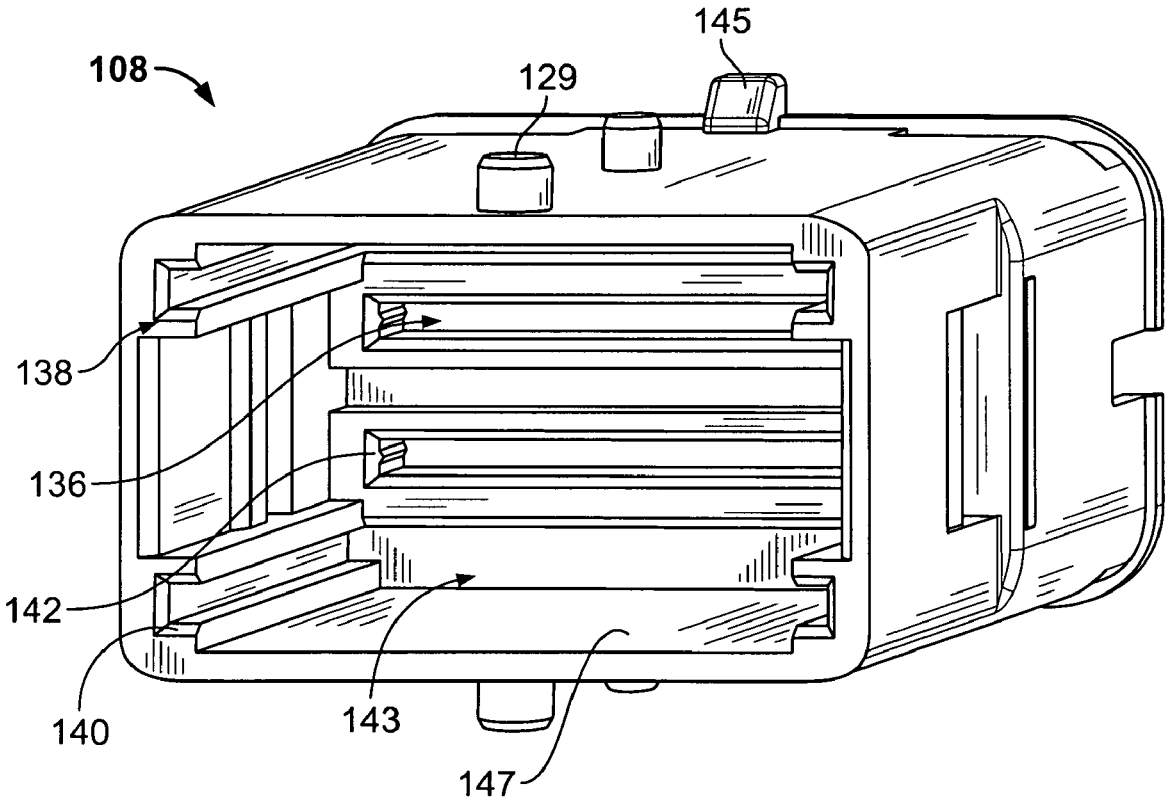
FIG. 4 is a rear perspective view of an exemplary plug sub-assembly housing.

As can be seen in FIGS. 3 and 4, the plug sub-assembly housing 108 includes a plug front housing surface 139 having plug contact sub-assembly slots 136 therethrough, and a plug sub-assembly housing rear cavity 143 at least partially defined by a plug sub-assembly support structure 138. The plug sub-assembly housing 108 further includes a keying feature 145.

As can be seen in FIG. 4, the plug sub-assembly support structure 138 includes guide rails 140 and slot supports 142 configured to receive and support plug contact sub-assemblies 144. In this exemplary embodiment, the plug 102 includes two plug contact sub-assemblies 144, and the plug sub-assembly support structure 138 is configured with guide rails 140 and a slot support 142 to support each plug contact sub-assembly 144. In another embodiment, the plug sub-assembly housing 108 may be provided with one or more slots 136, with guide rails 140 and slot supports 142 to receive and support a corresponding number of plug contact sub-assemblies 144. In yet another embodiment, not all slots 136, guide rails, and slot supports 142 may necessarily support a sub-assembly 144, or in other words, be left open.

Figure 5:
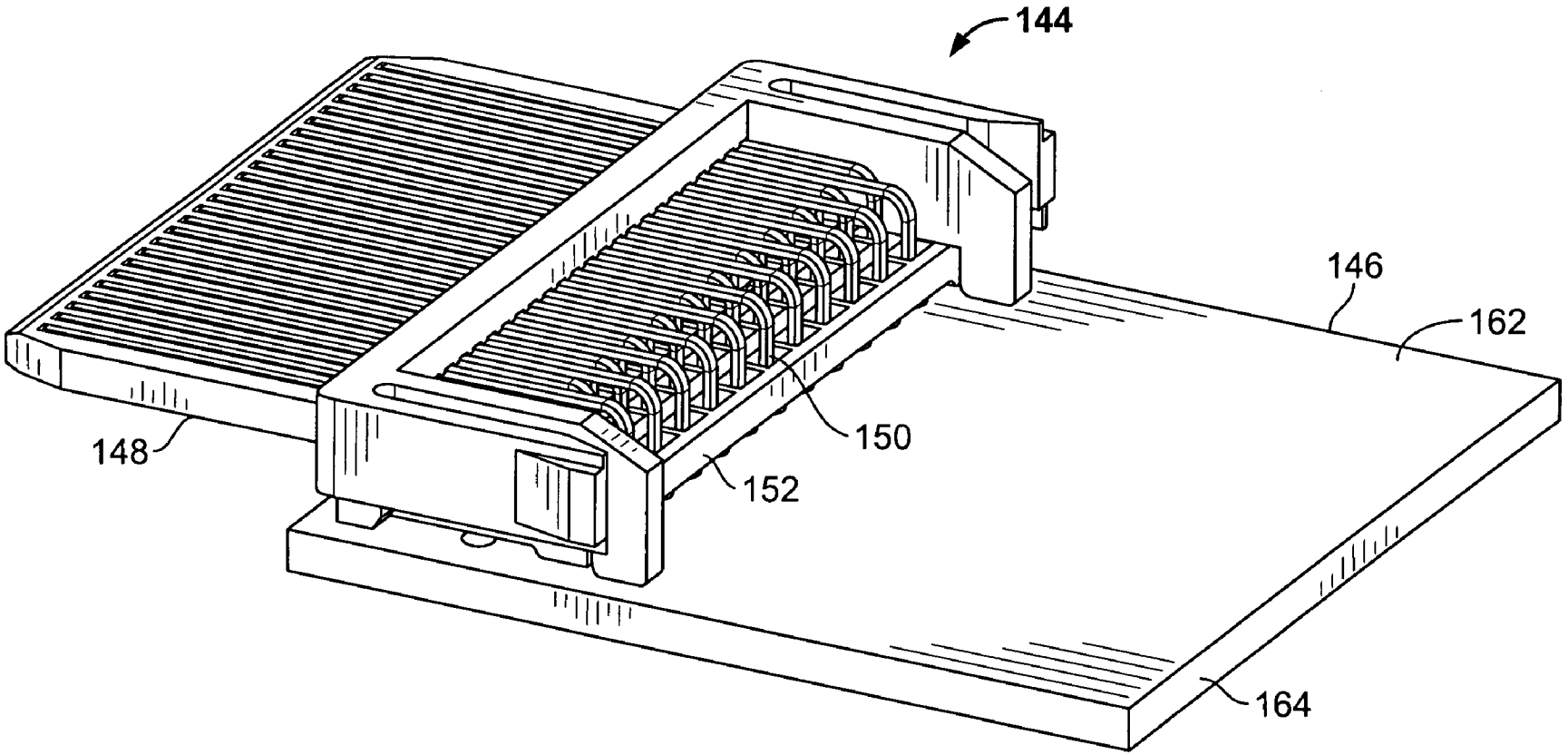
FIG. 5 is a perspective view of an exemplary plug contact sub-assembly.
Figure 5A:
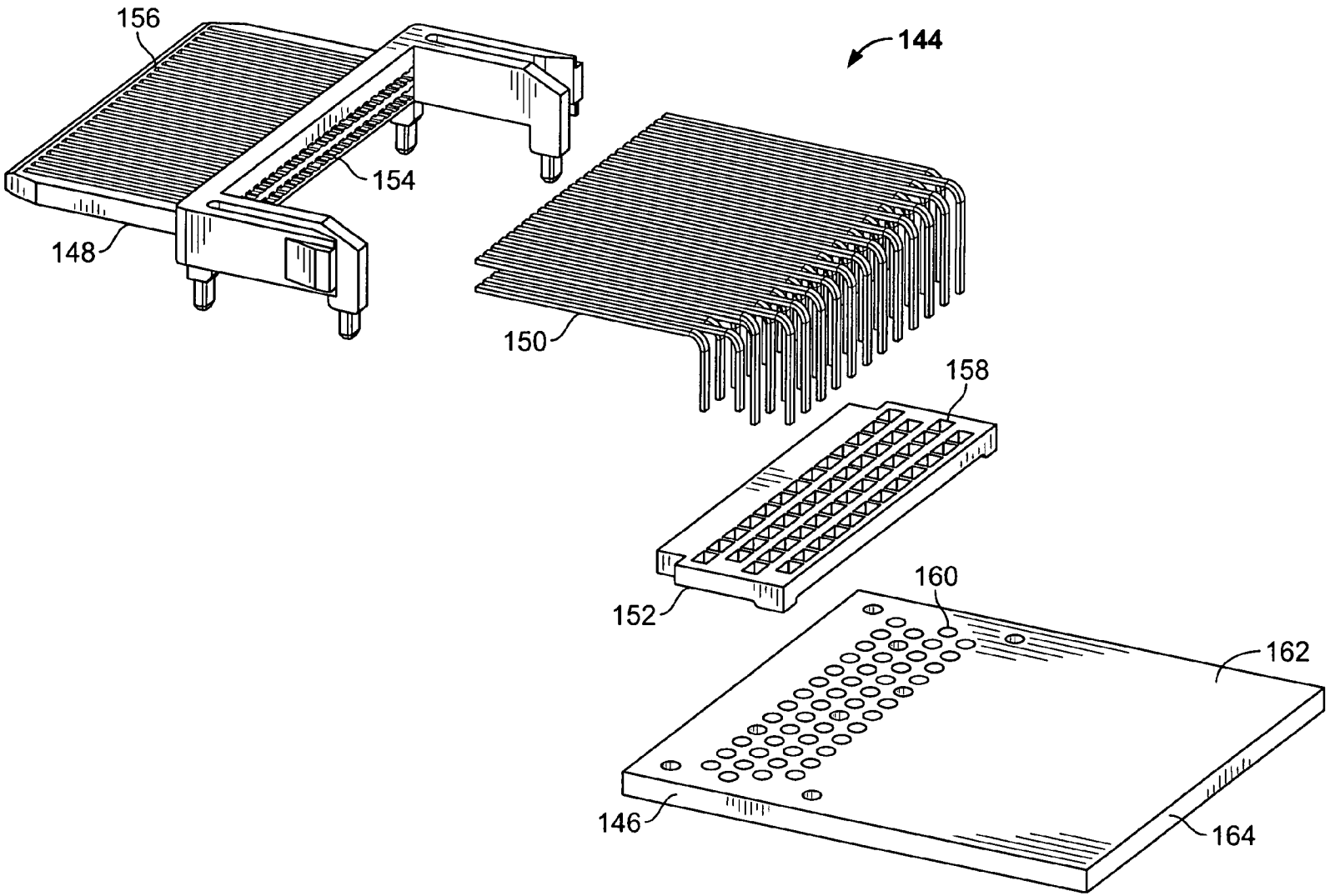
FIG. 5A is an exploded view of the plug contact sub-assembly of FIG. 5.

As can be seen in FIG. 3, the plug 102 includes two plug contact sub-assemblies 144. In another embodiment, the plug 102 may include at least one plug contact sub-assembly 144. A plug contact sub-assembly 144 is shown in greater detail in FIGS. 5 and 5A. The plug contact sub-assembly 144 includes a plug sub-assembly base 146, a plug contact support housing 148, a plurality of plug contacts 150, and a plug contact alignment spacer 152. In this exemplary embodiment, the plurality of plug contacts 150 are a plurality of stitched contacts, however, in other embodiments of the invention described below, other contacts may be used in the invention as described. In one embodiment, the plug sub-assembly base 146 may be a printed circuit board. The plug contact support housing 148 includes a plurality of openings 154 and a plurality of micro-channels 156 for receiving and supporting the plurality of contacts 150, respectively. The plurality of plug contacts 150 are further received through another plurality of openings 158 in the plug contact alignment spacer 152 prior to the plurality of plug contacts 150 being received through yet another plurality of openings 160 in the plug sub-assembly base 146. The plug contact alignment spacer 152 serves as an alignment aid for receiving and retaining the plurality of plug contacts 150 in the plug sub-assembly base 146. In another embodiment, the plug contact alignment spacer 152 may be formed by overmolding the plurality of plug contacts 150 to form a plug contact alignment spacer assembly (not shown) including the plurality of contacts 150 and the plug contact alignment spacer 152. After the plurality of plug contacts 150 are received through the plurality of openings in the plug sub-assembly base 146, the plurality of plug contacts 150 are terminated to pads, traces or other conductive paths (not shown) of the plug sub-assembly base 146. The conductive paths may be present on a top surface 162, a bottom surface (not shown), and interior surface (not shown), an edge surface 164, or any combination thereof of the plug sub-assembly base 146. A plurality of conductors (not shown) provided to the plug 102 through the flexible cable connector 109 are correspondingly terminated to the conductive paths and/or the plurality of plug contacts 150 as would be appreciated by one of ordinary skill in the art.

Figure 6A:
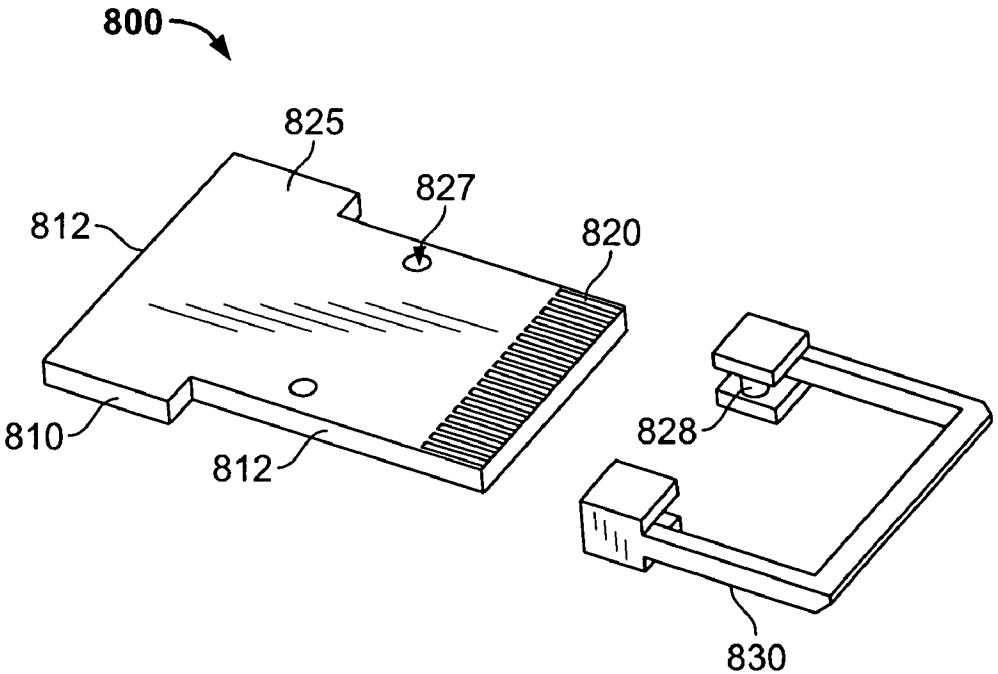
FIG. 6A is an exploded view of the contact sub-assembly of FIG. 6.
Figure 6:
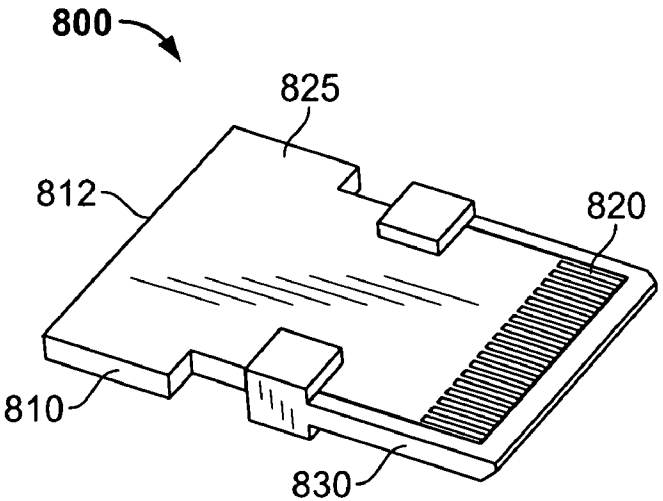
FIG. 6 is a perspective view of another exemplary plug contact sub-assembly.

FIGS. 6 and 6A show another exemplary plug contact sub-assembly 800 that may be used with the plug 102. Plug contact sub-assembly 800 includes a printed circuit board (PCB) 810 and an optional overmold 830. The PCB includes a plurality of contacts 820 disposed on a top surface 825. The plurality of contacts 820 are terminated to pads, traces or other conductive paths (not shown) of the PCB 810. The conductive paths may be present on a top surface 825, a bottom surface (not shown), and interior surface (not shown), an edge surface 812, or any combination thereof. A plurality of conductors (not shown) are provided to the plug 102 through the plug flexible cable connector 109 and are correspondingly terminated to the conductive paths and/or plurality of contacts 820 as would be appreciated by one of ordinary skill in the art. The PCB 810 includes through holes 827 for receiving projections 828 of the overmold 830 to attach to the overmold 830 to the PCB 810. Overmold 830 protects a plurality of spring contacts 200 (FIGS. 13A, B, C) from damage and wear during the mating and unmating of the plug 102 and the receptacle 104.

Figure 7:
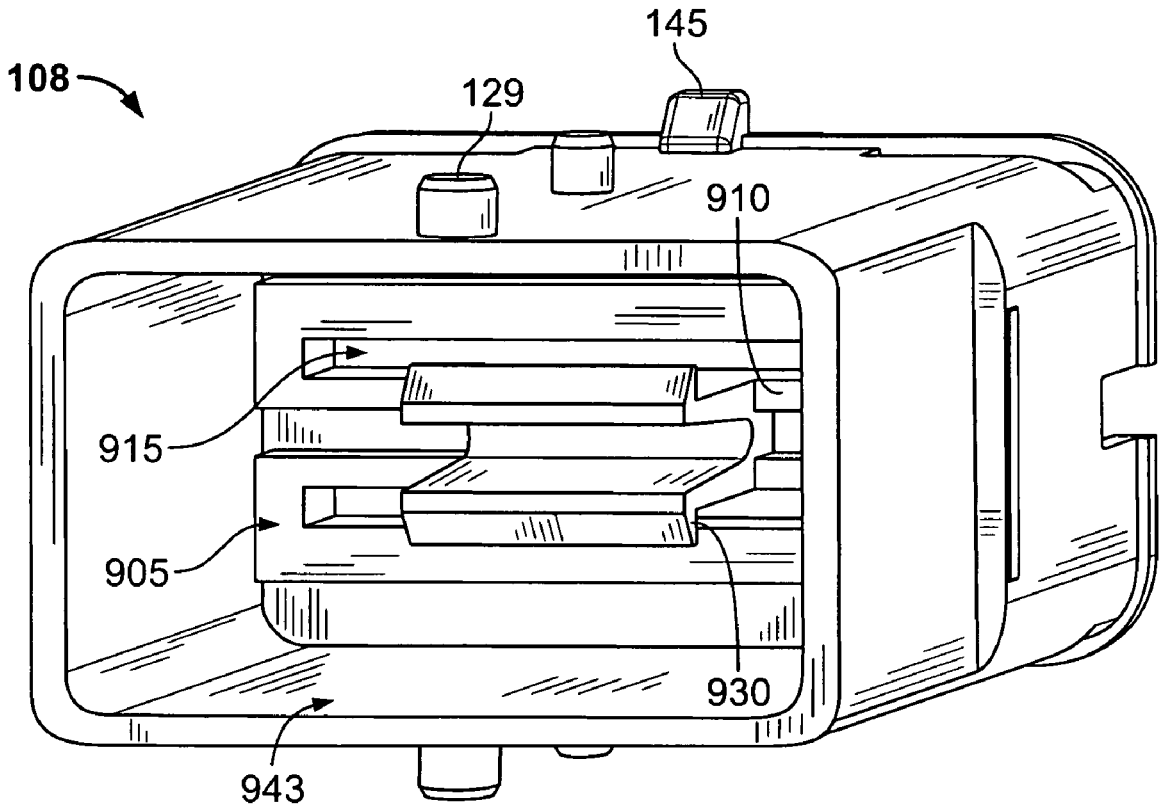
FIG. 7 is a rear view of another exemplary plug sub-assembly housing.

The plug sub-assembly housing 108 must be modified as shown in FIG. 7 for the exemplary plug contact sub-assembly 800 described above. The plug sub-assembly housing 108 is modified by replacing the plug sub-assembly support structure 138 (FIG. 4) with the plug sub-assembly support structure 905 as shown in FIG. 7. As can be seen in FIG. 7, plug sub-assembly housing 108 includes a rear cavity 943 at least partially defined by the plug sub-assembly support structure 905. The plug sub-assembly support structure 905 includes a plurality of support walls 910 and insertion slots 915. Support walls 910 include retention tabs 930 for supporting and securing plug contact sub-assembly 800 (FIG. 6). In this exemplary embodiment, the plug sub-assembly structure 905 is configured to support and secure two plug contact sub-assemblies 800, however, in another embodiment, the plug sub-assembly housing 108 may be provided with one or more insertion slots 915 and support walls 910 corresponding to the number of plug contact sub-assemblies 800 used.

Figure 8A:
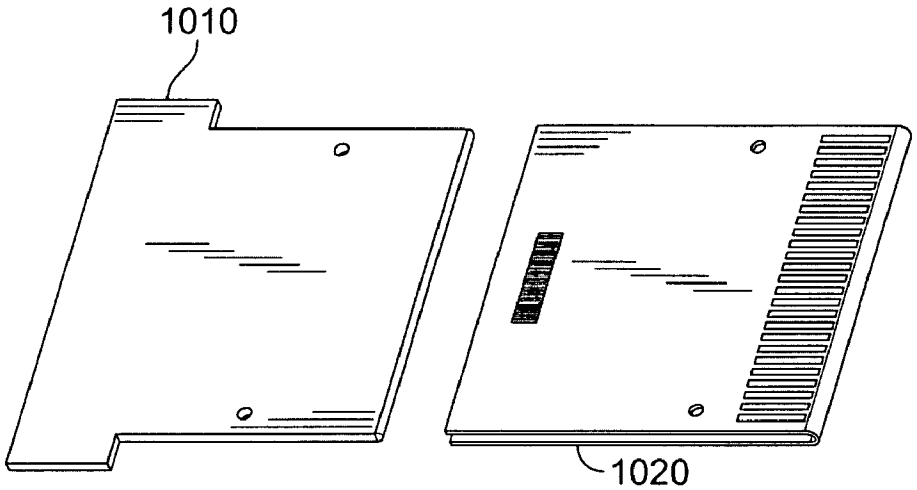
FIG. 8A is an exploded view of the plug contact sub-assembly of FIG. 8.
Figure 8:
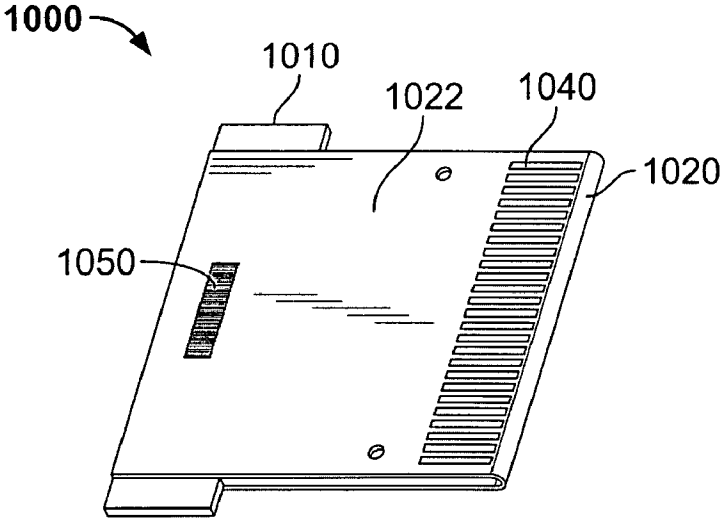
FIG. 8 is a perspective view of another exemplary plug contact sub-assembly.
Figure 8B:
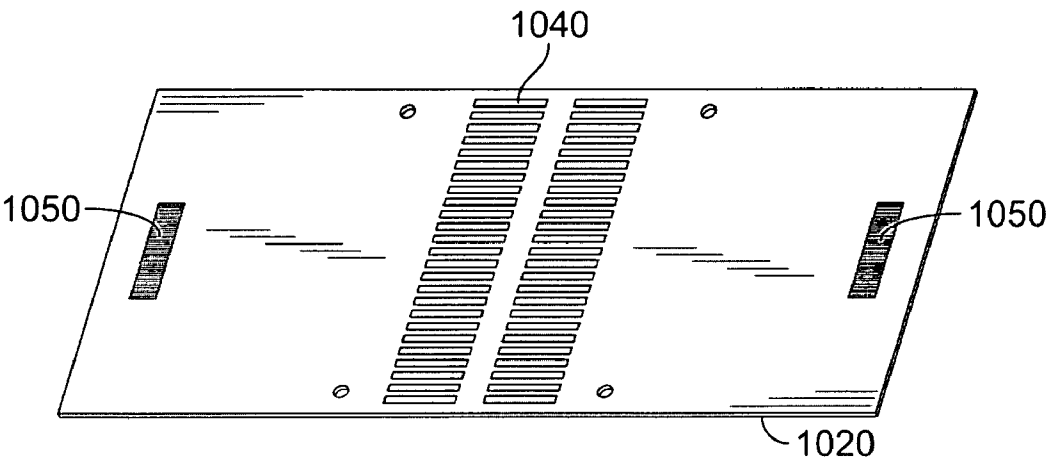
FIG. 8B is a perspective view of a flexible film, shown in a flat state, used in the plug contact sub-assembly of FIG. 8.

FIGS. 8, 8A and 8B show yet another exemplary plug contact sub-assembly 1000. Plug contact sub-assembly 1000 includes a support board 1010 and a flexible film contact assembly 1020. Flexible film contact assembly 1020 includes a first surface 1022 having a plurality of contacts 1040 disposed thereupon. The flexible film contact assembly 1020 also includes a second surface (not shown) opposite side surface 1022. The flexible film contact assembly 1020 further includes a plurality of conductive traces (not shown) providing an electrical path between the plurality of contacts 1040 and a plurality of contact pads 1050. The plurality of conductive traces may be disposed on the first surface 1022, second surface, between the first surface and the second surface, or any combination thereof. The plug contact sub-assembly 1000 is formed by applying the flexible film contact assembly 1020 to the support board 1010. The flexible film contact assembly 1020 may be applied to the support board 1010 by gluing or other known fastening methods. The plug contact sub-assembly 1000 is supported in the plug sub-assembly housing 108 by the plug contact assembly support structure 905 shown in FIG. 7.

Figure 9:
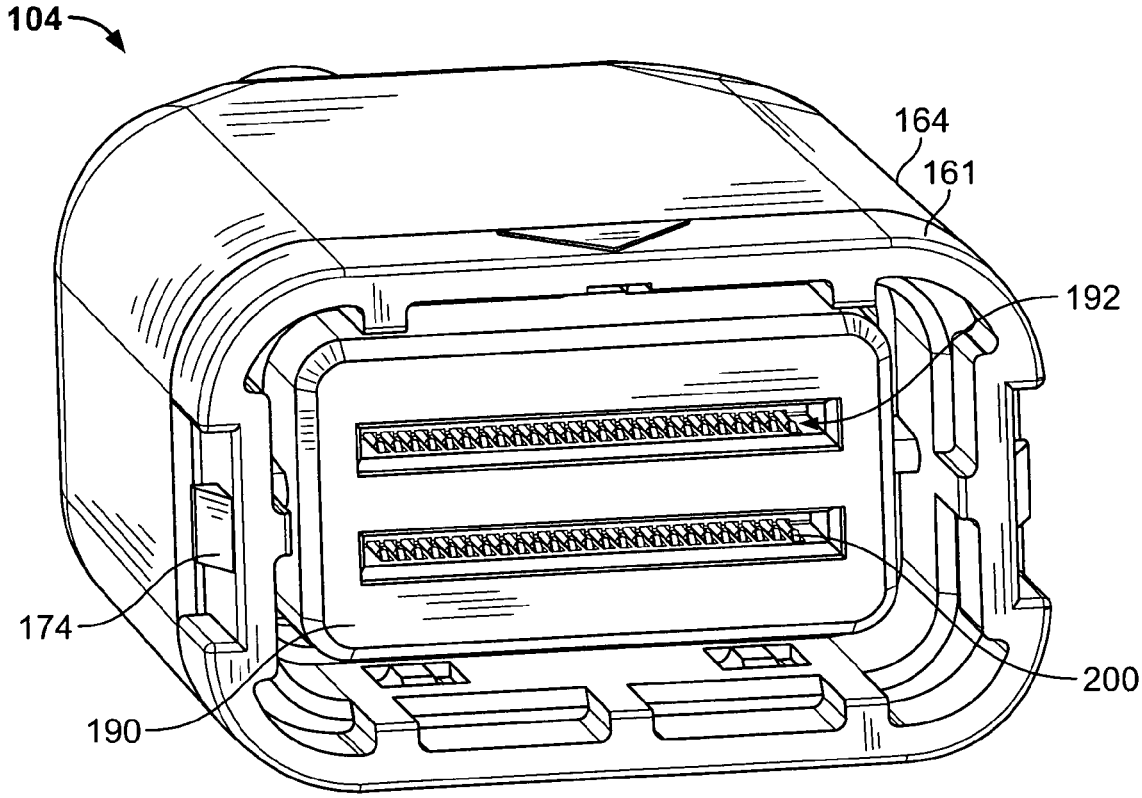
FIG. 9 is a front perspective view of the exemplary receptacle of FIG. 2.
Figure 10:
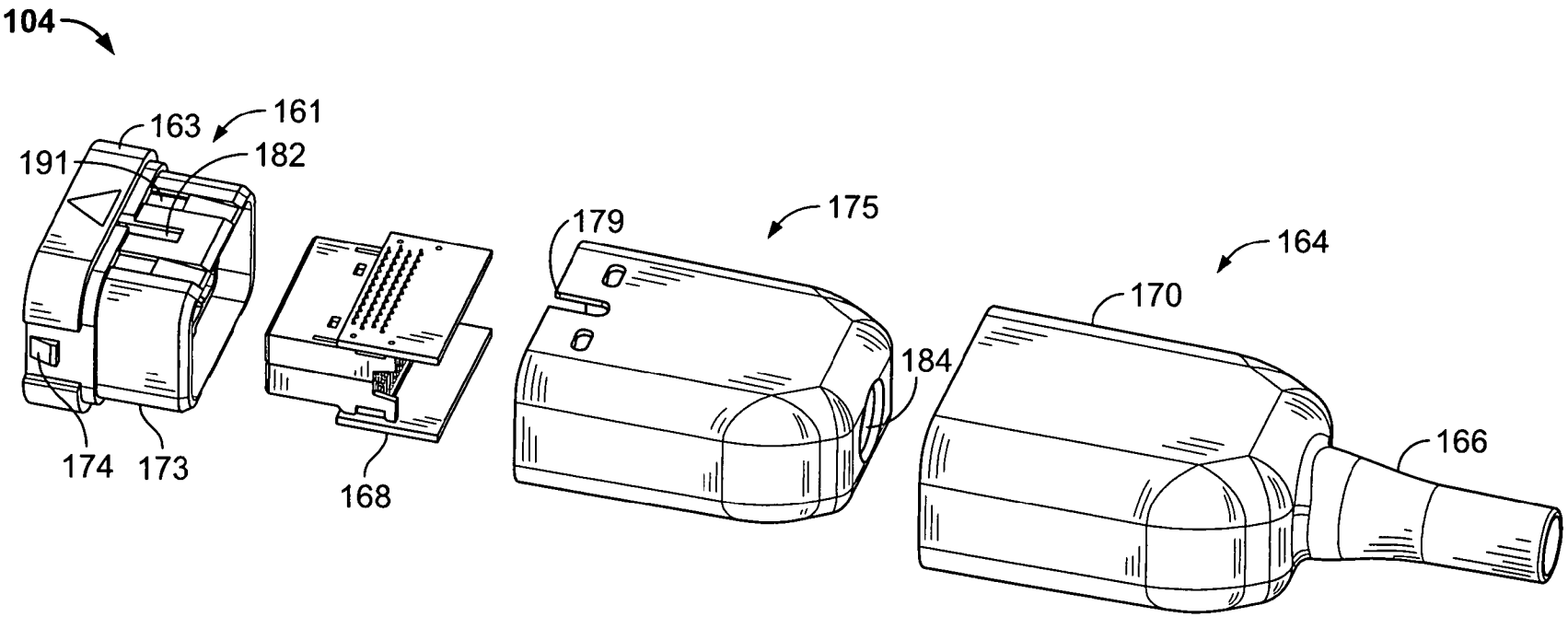
FIG. 10 is an exploded view of the receptacle of FIG. 9.

FIGS. 9 and 10 show receptacle 104 in greater detail. Receptacle 104 includes a receptacle sub-assembly housing 161, a spring contact sub-assembly 168, a receptacle shield 175, and a receptacle shell 164. The receptacle shell 164 includes a receptacle shell housing 170 and a receptacle flexible cable connector 166. In this exemplary embodiment, the receptacle shell 164 is formed by molding a soft elastic plastic material including both the shell housing 170 and receptacle flexible cable connector 166. In another embodiment, the receptacle shell housing 170 may be formed of two portions having a rear opening for securing the flexible cable connector 166 thereto. In another embodiment, the receptacle shell 164 may be formed from any thermoplastic material. In yet another embodiment, the receptacle shell housing 170 is formed of two hermaphroditic shell portions having a rear opening for securing the flexible cable connector 166 thereto. In still another exemplary embodiment, the receptacle shell 170 housing is a unitary body and the receptacle flexible cable connector 166 is a separate component that is securely attached thereto as would be appreciated by one of ordinary skill in the art.

Figure 11:
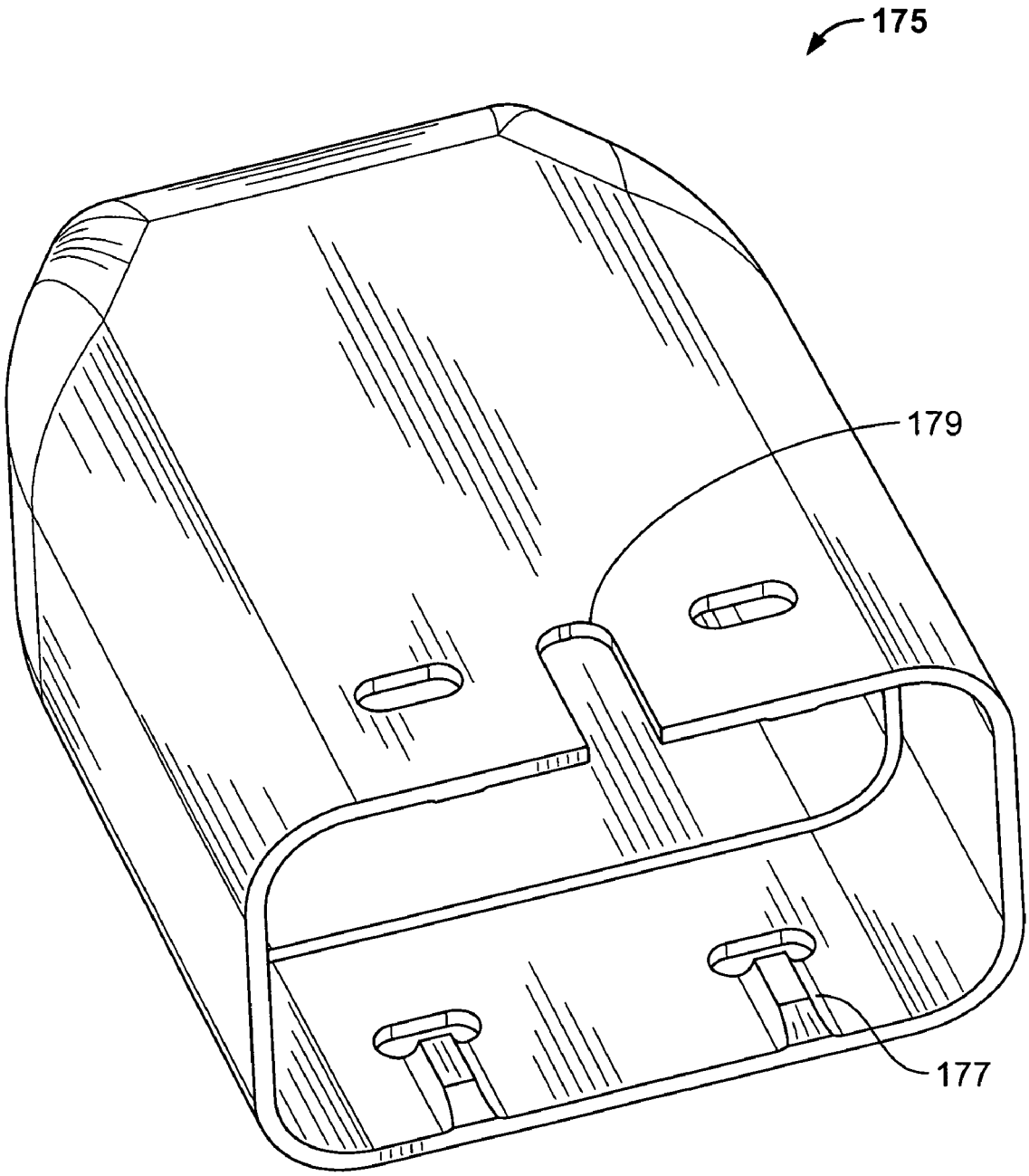
FIG. 11 is a perspective view of the receptacle shield of FIG. 10.

Referring to FIGS. 10 and 11, the receptacle shield 175 includes a rear opening 184 configured to provide access to conductors (not shown) provided through the flexible cable connector 166, which are terminated to the at least one spring contact sub-assembly housing 168. The receptacle shield 175 further includes protrusions 177 for engaging mating tabs 119 of the plug shield 116 to form a continuous electrical shield when the plug 102 and receptacle 104 are mated. The protrusions 177 also securely assemble the shield 175 to the housing 161. The receptacle shield 175 also includes a keying feature 179. In this exemplary embodiment, the receptacle shield 175 is configured to be securely retained within the receptacle shell 164 by bonding. In another embodiment, the receptacle shield 175 may be securely retained within the receptacle shell by clips, tabs or other similar fasteners. In another embodiment, the receptacle shield 175 may be omitted from the receptacle 104, and the receptacle shell housing 170 may be plated with an electrical shielding material (not shown). In this another embodiment, the receptacle shell housing 170 may includes protrusions 177. In still another embodiment, the receptacle shield 175 may be omitted, and no electrical shielding material may be included in the receptacle 104. In this still another embodiment, the protrusions 177 may be included on the receptacle shell housing 170 to securely assemble the receptacle shell 164 to the receptacle sub-assembly housing 161. In another embodiment, the receptacle shell 164 may be securely assembled to the receptacle sub-assembly housing 161 by other gluing, welding, tabs, clips or other fastener structures or methods.

Figure 12:
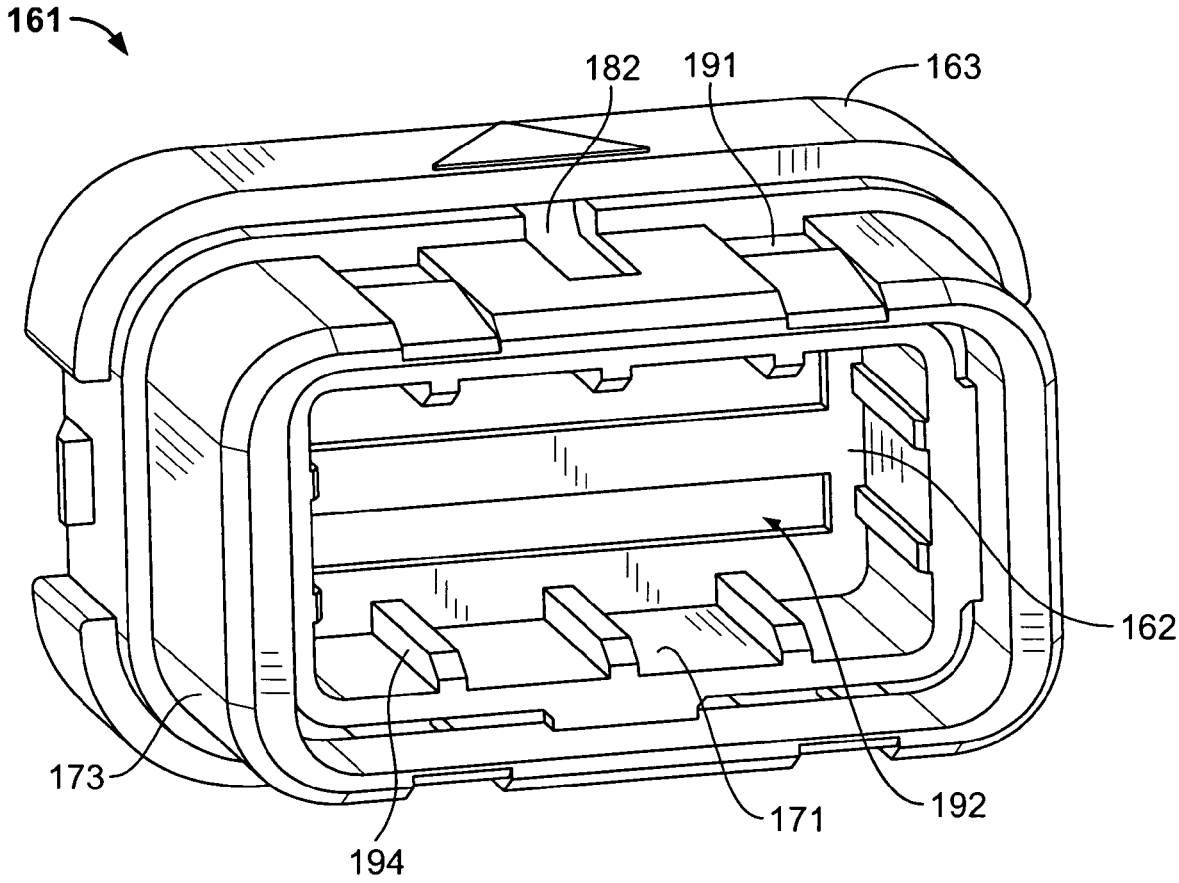
FIG. 12 is a rear view of an exemplary receptacle sub-assembly housing.

Referring to FIGS. 9, 10 and 12, the receptacle sub-assembly housing 161 includes a front portion 163 and a rear portion 173. The front portion 163 includes tabs 174 configured to engage plug latches 110. The front portion 163 further includes a front receptacle housing surface 190 disposed therewithin. The front receptacle housing surface 190 includes receptacle contact sub-assembly slots 192 therethrough.

The rear portion 173 is configured to be received within the receptacle shield 175. The rear portion 173 includes slots 191 configured to receive protrusions 177 of the receptacle shield 175 to securely assembly the receptacle sub-assembly housing 161 thereto. The rear portion 173 further includes an interior surface 171. In another embodiment, the interior surface 171 may be plated with an electrical shielding material.

As can be further seen in FIG. 10, the receptacle sub-assembly housing 161 further includes a receptacle sub-assembly housing keying feature 182 that aligns with corresponding receptacle shield keying feature 179. The receptacle sub-assembly housing keying feature 182 and receptacle shield keying feature 179 engage plug sub-assembly housing keying feature 145 of the plug sub-assembly housing 108 (FIG. 3).

FIG. 12 shows a rear view of the receptacle sub-assembly housing 161. As can be seen in FIG. 12, the receptacle sub-assembly housing 161 includes a cavity 162 at least partially defined by spring contact sub-assembly slots 192. The spring contact sub-assembly support slots 192 includes guide rails 194 configured to receive and support at least one spring contact sub-assembly 168. In this exemplary embodiment, the receptacle 104 includes two spring contact sub-assemblies 168. In another embodiment, the receptacle sub-assembly housing 161 may be provided with one or more spring contact sub-assembly slots 192 to receive and support a corresponding number of spring contact sub-assemblies 168. In yet another embodiment, not all slots 192 may necessarily be provided with a spring contact sub-assembly 168, or in other words, be left open.

Figure 13:
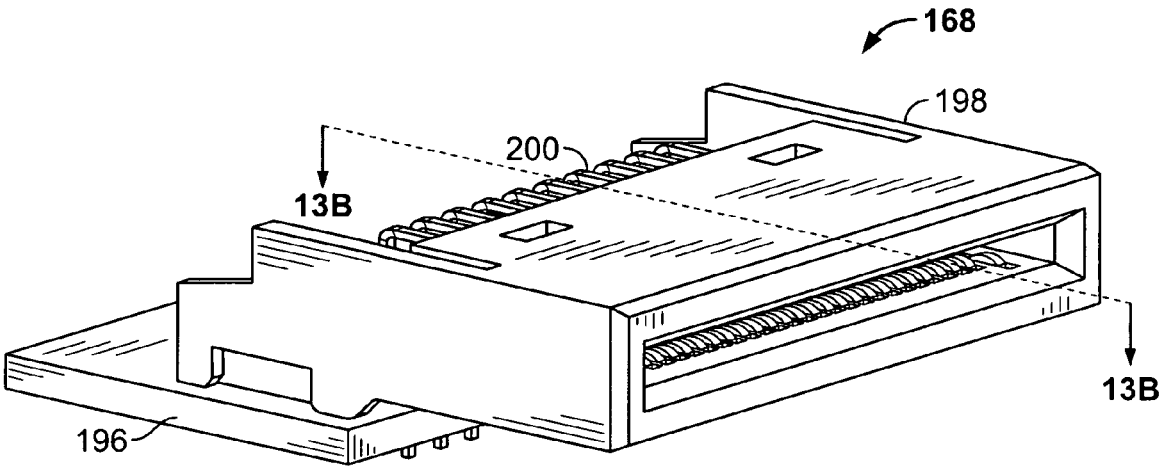
FIG. 13 is a perspective view of an exemplary spring contact sub-assembly according to the invention.

As can be seen in FIG. 10, the receptacle 104 includes two spring contact sub-assemblies 168. A spring contact sub-assembly 168 is shown in greater detail in FIGS. 13, 13A and 13B. The spring contact sub-assembly 168 includes a sub-assembly base 196, a contact support housing 198, a plurality of spring contacts 200, and a contact alignment spacer 202. The spring contact sub-assembly 168 may include an optional spring contact assembler 204. The sub-assembly base 196 includes a top surface 212, a bottom surface (not shown), and an edge surface 216. In another embodiment, the spring contact assembler 204 may also be overmolded with the plurality of spring contacts 200. In another embodiment, the receptacle 104 may include at least one spring contact sub-assemblies 168.

Figure 13B:
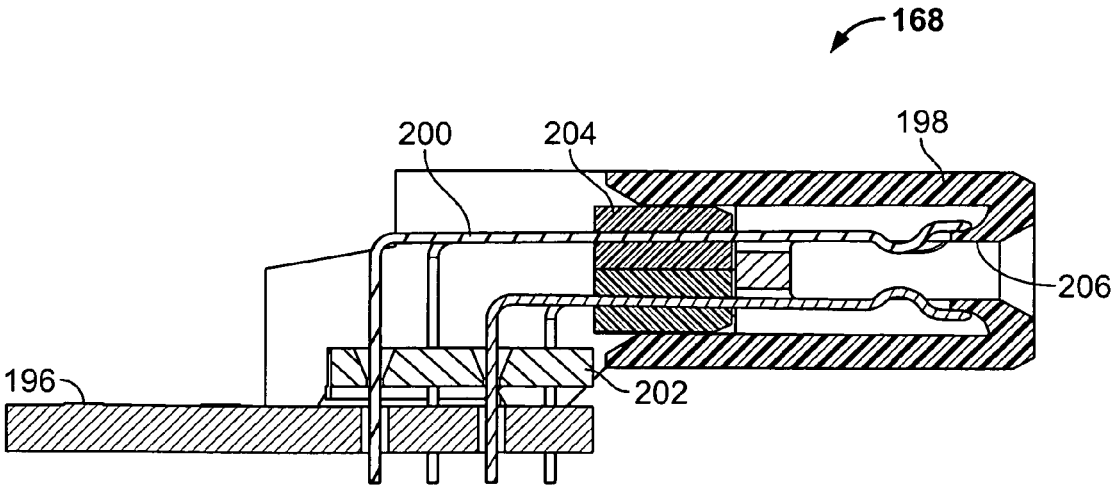
FIG. 13B is a cross-sectional view of FIG. 13 taken along line 13B-13B.

As can be seen in FIG. 13B, the contact support housing 198 includes a retaining surface 206 for receiving and supporting the plurality of spring contacts 200 in a preloaded configuration. The retaining surface 206 forces the plurality of spring contacts 200 open beyond the spring contacts natural free state but not to the total amount of travel when mated with the corresponding plurality of plug contacts 150. In another embodiment, the contact support housing would not include the retaining surface 206 and the plurality of spring contacts 200 may not be in a preloaded configuration.

Figure 13A:
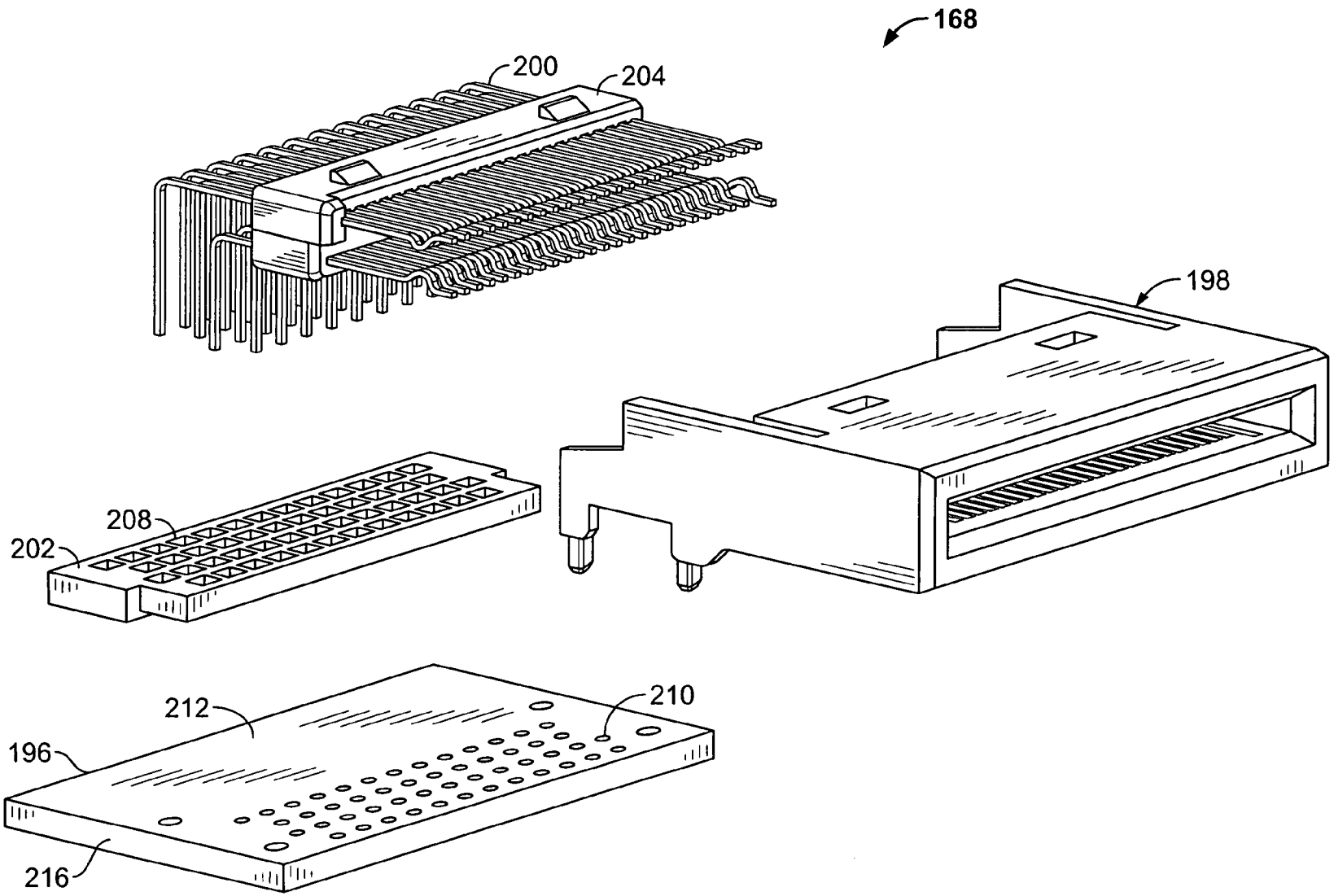
FIG. 13A is an exploded view of the spring contact sub-assembly of FIG. 13.

As can be seen in FIG. 13A, the plurality of spring contacts 200 are further received through a plurality of openings 208 in the contact alignment spacer 202 prior to the plurality of spring contacts 200 being received through yet another plurality of openings 210 in the sub-assembly base 196. The contact alignment spacer 202 serves as an alignment aid for receiving the plurality of spring contacts 200 in the sub-assembly base 196. After the plurality of spring contacts 200 are received through the plurality of openings 210 in the sub-assembly base 196, the plurality of spring contacts 200 are terminated to traces, contact pads, conductive paths (not shown), and/or any combination thereof provided on the top surface 212, bottom surface (not shown) and/or edge surface 216 and/or any combination thereof of the sub-assembly base 196. A plurality of conductors (not shown), provided to the receptacle 104 through flexible cable connector 166, are correspondingly terminated to the traces, contact pads, conductive paths, the plurality of spring contacts 200, or any combination thereof as would be appreciated by one of ordinary skill in the art.

Figure 13C:
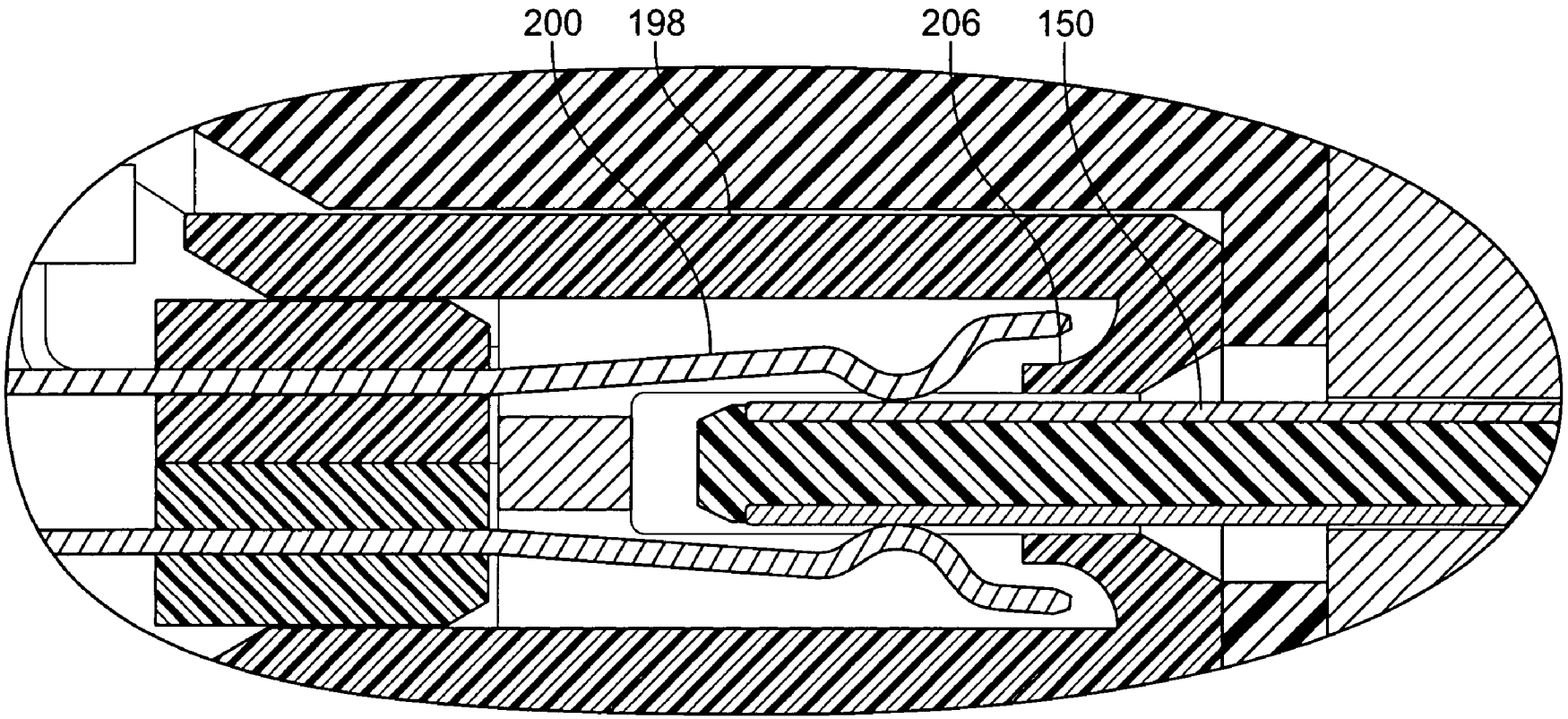
FIG. 13C is an expanded view of a portion of FIG. 13B with a plug contact inserted.

FIG. 13C shows an enlarged view of a portion of FIG. 13B, including a plug contact 150 inserted therein. As can be seen in FIG. 13C, the spring contact 200 has been expanded by receiving plug contact 150 so as to disengage the spring contact 200 from the retaining surface 206, thereby assuring a positive electrical connection between the plug contact 150 and spring contact 200.

Figure 14:
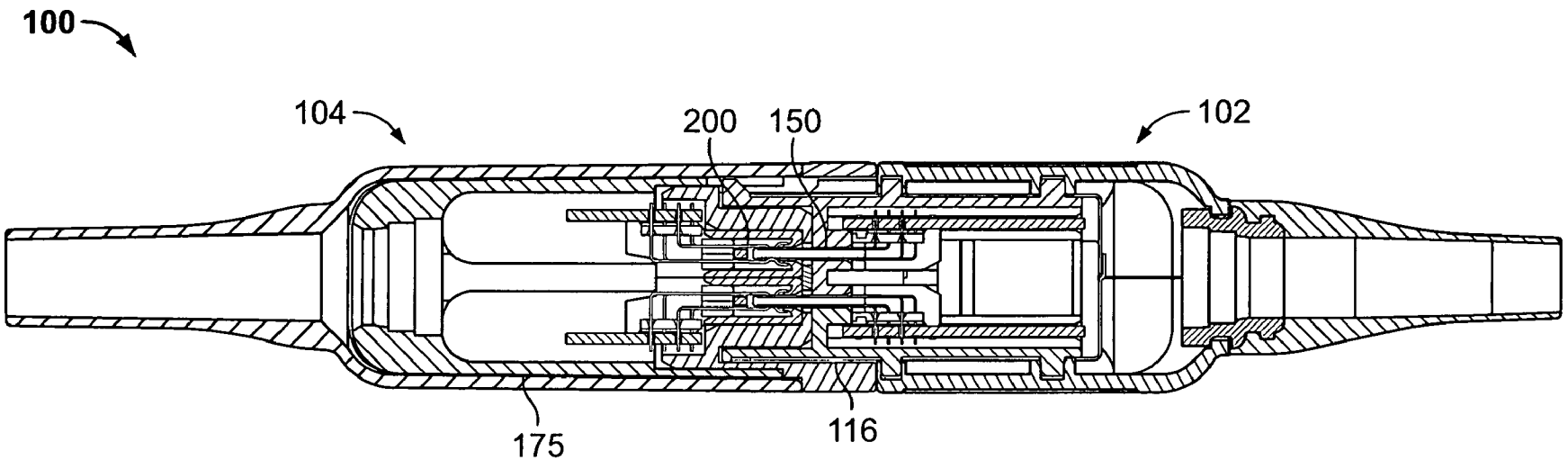
FIG. 14 is a cross sectional view of the mated electrical connector of FIG. 1 taken along line 14-14.

A cross sectional view of the mated electrical connector 100 of FIG. 1 taken along line 14-14 is shown in FIG. 14. As can be seen in FIG. 14, when the plug 102 and receptacle 104 are mated, a plurality of plug contacts 150 are mated to corresponding plurality of spring contacts 200 to form an electrical connection therebetween. Additionally, the plug shield 116 is in conductive communication with the receptacle shield 175 to form a continuous shield surrounding the plug and spring contact sub-assemblies 144, 168, respectively.

Figure 15:
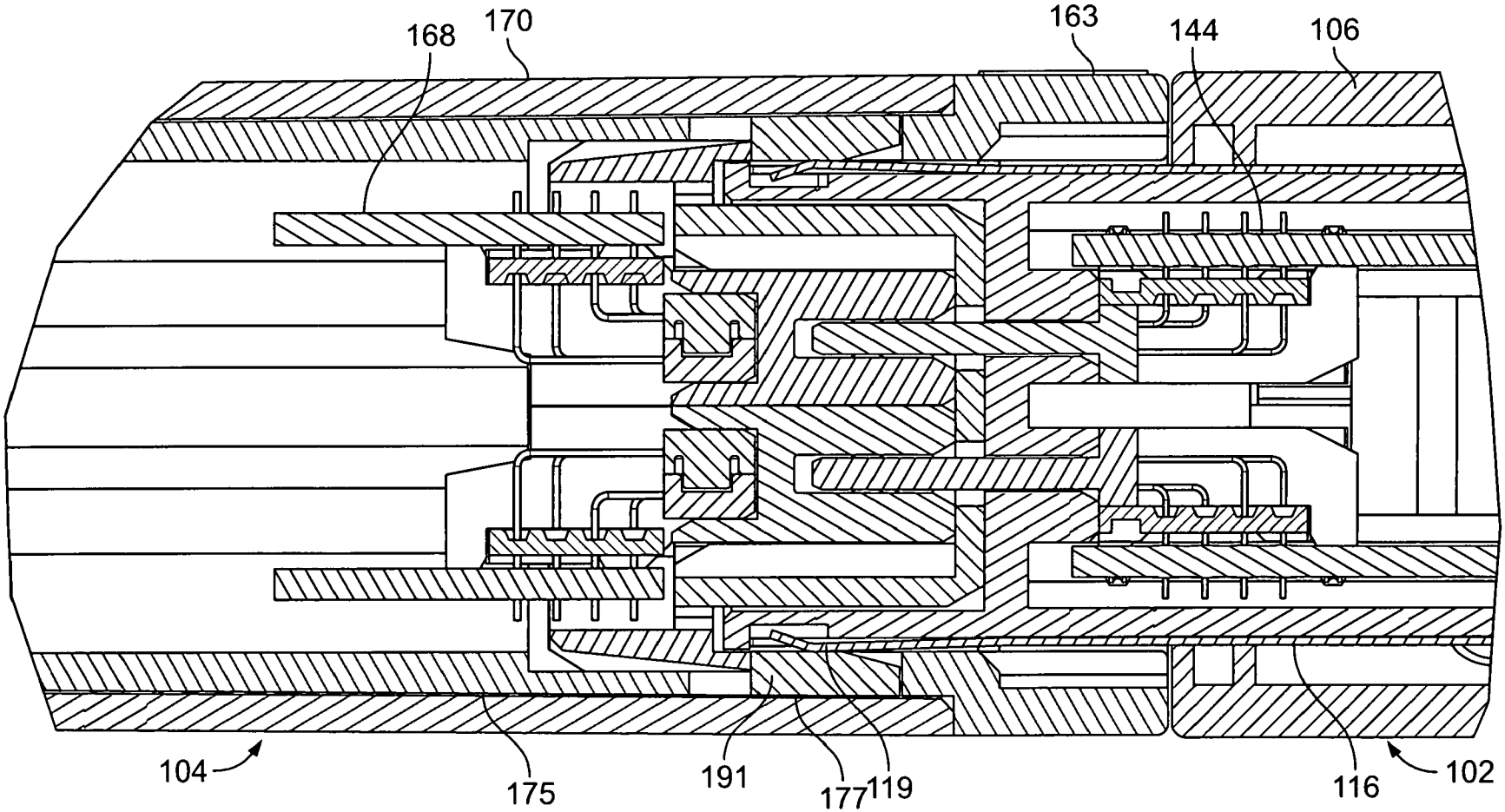
FIG. 15 is a partial cross sectional view of the mated electrical connector of FIG. 1 taken along line 15-15.

A partial cross sectional view of the mated electrical connector 100 of FIG. 1 taken along line 15-15 is shown in FIG. 15. As can be seen in FIG. 15, when the plug 102 and receptacle 104 are mated, the tabs 119 of plug shield 116 contact the protrusions 177 of receptacle shield 175 through slots 191 to form a continuous electrical shield formed by the plug shield 116 and receptacle shield 175 around the plug contact sub-assembly 144 and the spring contact sub-assembly 168.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector, comprising:

a plug comprising:

a plug shell;

a plug sub-assembly housing disposed within the plug shell; and at least one plug contact sub-assembly disposed within the plug sub-assembly housing, the at least one plug contact sub-assembly comprising a plurality of plug contacts, a plug sub-assembly base and a plug contact alignment spacer; and a receptacle comprising:

a receptacle shell;

a receptacle sub-assembly housing assembled to the receptacle shell; and at least one spring contact sub-assembly disposed within the receptacle sub-assembly housing, the at least one spring contact sub-assembly comprising a plurality of spring contacts, a sub-assembly base, a contact alignment spacer, and a spring contact assembler;

wherein the plug and receptacle are configured to mate, thereby mating the plurality of plug contacts and the plurality of spring contacts.

2. The electrical connector of claim 1, wherein the plug further comprises a plug shield disposed around the at least one plug contact sub-assembly and the receptacle further comprises a receptacle shield disposed around the at least one spring contact sub-assembly, the plug and receptacle configured to electrically contact the plug shield and receptacle shield when mated.

3. The electrical connector of claim 2, wherein the plug shield is a body disposed around the at least one plug contact sub-assembly.

4. The electrical connector of claim 2, wherein the plug shield is an electrical shielding material plated on an exterior surface of the plug sub-assembly housing.

5. The electrical connector of claim 2, wherein the receptacle shield is a body disposed around the at least one spring receptacle sub-assembly.

6. The electrical connector of claim 2, wherein the receptacle shield is an electrical shielding material plated on an inside surface of the receptacle plug.

7. The connector of claim 1, wherein the plug sub-assembly housing comprises a plug sub-assembly housing disposed within a plug shield.

8. The connector of claim 1, wherein the plug sub-assembly housing comprises a plug sub-assembly support structure configured to receive and support the at least one plug contact sub-assembly.

9. The connector of claim 1, wherein the receptacle sub-assembly housing comprises at least one spring contact sub-assembly support slot including guide rails configured to receive and support the at least one spring contact sub-assembly.

10. The connector of claim 1, wherein the plurality of spring contacts are preloaded with an opening force.

11. The connector of claim 1, wherein the receptacle sub-assembly includes a retaining surface configured to preload the plurality of spring contacts with an opening force.

12. The connector of claim 1, wherein the plug contacts are stitched contacts.

13. The connector of claim 1, wherein the plurality of plug contacts are disposed on a printed circuit board.

14. The connector of claim 1, wherein the plurality of plug contacts are disposed on a flexible film contact assembly.

15. An electrical connector comprising a plug comprising:

a plug shell;

a plug sub-assembly housing disposed within the plug shell;

at least one plug contact sub-assembly disposed within the plug sub-assembly housing, the at least one plug contact sub-assembly comprising a plurality of plug contacts; and a plug shield disposed around the at least one plug contact sub-assembly, the plug shield comprising two hermaphroditic plug shield portions; and a receptacle comprising:

a receptacle shell;

a receptacle sub-assembly housing assembled to the receptacle shell;

at least one spring contact sub-assembly disposed within the receptacle sub-assembly housing, the at least one spring contact sub-assembly comprising a plurality of spring contacts; and a receptacle shield which is a body disposed around the at least one spring contact sub-assembly wherein the plug and receptacle are configured to mate, thereby mating the plurality of plug contacts and the plurality of spring contacts and electrically contacting the plug shield and the receptacle shield.

16. An electrical connector comprising a plug comprising:

a plug shell comprising two hermaphroditic plug shell portions;

a plug sub-assembly housing disposed within the plug shell; and at least one plug contact sub-assembly disposed within the plug sub-assembly housing, the at least one plug contact sub-assembly comprising a plurality of plug contacts; and a receptacle comprising:

a receptacle shell;

a receptacle sub-assembly housing assembled to the receptacle shell; and at least one spring contact sub-assembly disposed within the receptacle sub-assembly housing, the at least one spring contact sub-assembly comprising a plurality of spring contacts;

wherein the plug and receptacle are configured to mate, thereby mating the plurality of plug contacts and the plurality of spring contacts.

* * * * *